United States Patent [19]

Patt et al.

[11] Patent Number: 4,964,828

[45] Date of Patent: Oct. 23, 1990

[54] METHOD OF MANUFACTURING A COLOR DISPLAY TUBE AND A COLOR DISPLAY TUBE

[75] Inventors: Paul J. Patt, Mt Kisco, N.Y.; Gerardus J. A. M. Notenboom, Eindhoven, Netherlands

[73] Assignee: U.S. Philips Corporation, New York, N.Y.

[21] Appl. No.: 389,724

[22] Filed: Aug. 4, 1989

[30] Foreign Application Priority Data

Aug. 4, 1988 [NL] Netherlands ..... 8801943

[51] Int. Cl.[5] ..... H01J 9/44

[52] U.S. Cl. ..... 445/4; 313/402; 313/404; 445/30

[58] Field of Search ..... 445/3, 4, 30; 313/402, 313/407, 404

[56] References Cited

U.S. PATENT DOCUMENTS

| | | | |
|---|---|---|---|
| 3,468,005 | 9/1969 | Kautz | 445/30 |
| 3,643,299 | 2/1972 | Brown | 445/3 X |
| 4,652,791 | 3/1987 | Palac et al. | 445/30 X |
| 4,756,702 | 7/1988 | Steiner | 445/30 |

FOREIGN PATENT DOCUMENTS

| | | | |
|---|---|---|---|
| 57776 | 5/1977 | Japan | 313/407 |

*Primary Examiner*—Kenneth J. Ramsey
*Attorney, Agent, or Firm*—John C. Fox

[57] ABSTRACT

A method of manufacturing a color display tube comprising a display window having a display screen, a flat tensed shadow mask 2 in which the shadow mask 2 is provided with strips 9, 14, 15, 16, along its edges the color display tube has been assembled a test pattern is displayed on the display screen via the shadow mask 2, and certain strips are irradiated using an electron beam or a laser beam, to obtain a desired test pattern by aligning the shadow mask 2 relative to the display screen.

7 Claims, 4 Drawing Sheets

METHOD OF MANUFACTURING A COLOR DISPLAY TUBE AND A COLOR DISPLAY TUBE

CROSS REFERENCE TO RELATED APPLICATION

U.S. patent application Ser. No. 279,889, filed Dec. 5, 1988, claims a flat tension mask having a border pattern of slits designed to maintain a uniform tension across the mask after mounting. The mask is mounted so that the slits are entirely free of the mounting means.

BACKGROUND OF THE INVENTION

The invention relates to a method of manufacturing a colour display tube, in which a display window is provided with a display screen of phosphor elements luminescing in different colours, a tensed substantially rectangular shadow mask which is provided with a large number of apertures is suspended in the display window, and an enveloping part is secured to the display window, such that an envelope is formed.

The invention also relates to a colour display tube produced by such a method.

A method of the type mentioned in the opening paragraph is known from U.S. Pat. No. 4,547,696, in which the display window and the shadow mask, the latter being provided on a frame, are first placed in a defined position relative to one another by means of a first plurality of reference cavities in the frame, a second plurality of reference cavities in the window and a number of spherical reference elements which fit in the reference cavities. A third plurality of reference cavities is provided on the frame to place the frame together with the display window in a defined position relative to a lighthouse. Subsequently, the phosphor elements of the display screen luminescing in different colours are provided on the display window by means of a multi-step photographic process, in which the display window is repeatedly detached from the frame and replaced in the same relative position by means of the spherical reference elements and the reference cavities. After the display screen is formed, a conical enveloping part the edge of which is provided with a fourth plurality of reference cavities, is placed on the frame by means of spherical reference elements which fit in the reference cavities, and secured thereto by means of a glass frit.

To obtain a satisfactorily operating colour display tube the ultimate positioning of the parts relative to one another must be sufficiently exact. To this end, the reference means used for positioning the parts relative to one another must be manufactured accurately such that the parts can be reproducibly positioned relative to one another in the accurately defined position.

Not only in the method as described in U.S. Pat. No. 4,547,696 but also in other known methods of manufacturing a colour display tube, the tube is heated to approximately 400° C. during securing the enveloping part to the display window and during evacuating the envelope of the colour display tube. During this heating step the shadow mask expands and it has been found in practice that when the colour display tube has cooled the shadow mask does not always resume its original position. Owing to this, the apertures in the shadow mask may be displaced relative to the phosphor elements of the display screen, thereby causing colour errors in the colour display tube.

OBJECT AND SUMMARY OF THE INVENTION

One of the objects of the invention is to provide a method of manufacturing a colour display tube, in which the occurrence of colour errors is substantially completely precluded.

To this end, a method of the type mentioned in the opening paragraph is characterized in accordance with the invention in that after the envelope is formed the shadow mask and the display window are positioned relative to one another by locally deforming the tensed shadow mask by applying energy. Since the shadow mask can now be positioned relative to the display window after the envelope has been formed, it becomes possible to compensate for displacement differences between the display window and the shadow mask which are produced during the manufacture of the colour display tube, and to place the shadow mask in a desired position relative to the display window.

A preferred embodiment of a method in accordance with the invention is characterized in that prior to suspending the shadow mask a large number of slots are formed in at least one of its edges, such that strips are formed along such edge of the shadow mask, the shadow mask is thereafter suspended in display window using tension, such that the slots remain free in part, and positioning the shadow mask relative to the screen by the selective application of energy to strips. Thus, a readily conceivable way of positioning the shadow mask in a defined manner relative to the display window is obtained, while maintaining a vacuum in the envelope. Positioning the shadow mask is based on the fact that the strips provided at the edge of the shadow mask behave as springs.

If the shadow mask is suspended in the display window using tension, the strips which are located substantially opposite one another are in an equilibrium such that the apertures in the shadow mask are in a certain position relative to the phosphor elements. By applying energy to some of the strips the equilibrium and, consequently, the position of the apertures in the shadow mask relative to the phosphor elements is changed. In this changed equilibrium the shadow mask permanently occupies the changed position relative to the display screen.

In a further preferred embodiment of a method in accordance with the invention, energy is readily applied to the strips by means of irradiation using an electron beam which is generated by an electrode system which is arranged in the enveloping part. Alternatively, the energy is applied by irradiation using a laser beam which passes through a light-transmitting aperture in the envelope.

In another preferred embodiment, a test pattern generated by the tube is displayed on the display screen via the shadow mask, and positioning of the mask takes place until a desired test pattern is displayed, and the shadow mask is accurately aligned relative to the display screen, which results in a satisfactorily operating colour display tube. The use of the tube's electrode system for generating the test pattern and for applying energy to strips additionally provides an elegant method of manufacturing a colour display tube.

In accordance with another aspect of the invention, a colour display tube is provided, having an envelope, a display window which is provided with a display screen of phosphor elements luminescing in different colours, and a tensed substantially rectangular shadow mask having a large number of apertures and suspended in the envelope, which tube enables an image to be displayed substantially without colour errors, characterized in that the shadow mask is provided with strips at at least one of its edges, the lengths and widths of the strips and the interspace between the strips being such that in the case of deformation of at least one of the strips the shadow mask can be positioned relative to the display window in a controlled manner.

In a preferred embodiment of such a colour display tube, the shadow mask is suspended in the envelope so as to be tensed at all the edges, and has recesses in its corners to uniformly distribute the mechanical tension in the corners of the shadow mask whereby any colour errors occurring in the corners of an image to be displayed are avoided.

BRIEF DESCRIPTION OF THE DRAWINGS

The invention will now be described in greater detail in terms of a few exemplary embodiments and with reference to a drawing, in which.

DESCRIPTION OF THE PREFERRED EMBODIMENTS

Figure 1:
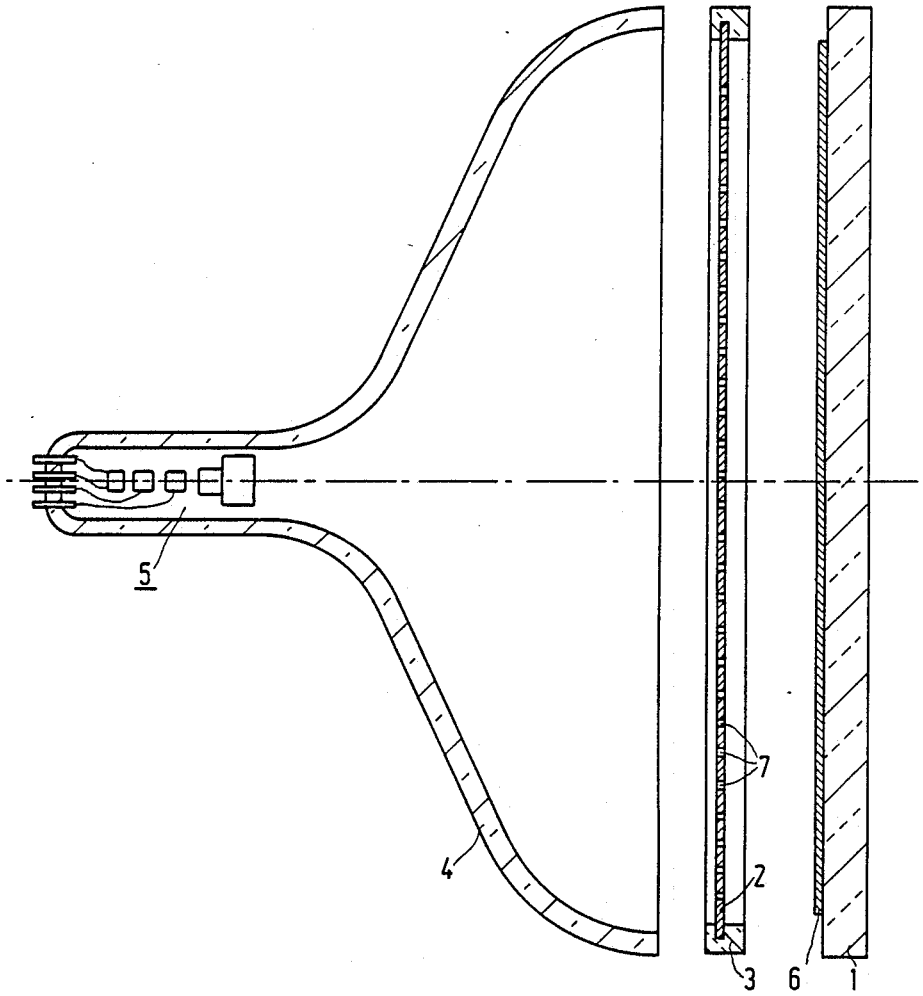
FIG. 1 is a diagrammatic sectional view of a colour display tube having a tensed shadow mask, before the envelope is formed.

FIG. 1 diagrammatically shows parts of a colour display tube before they are assembled to form an envelope. These parts are a display window 1, a shadow mask 2 which is secured to a frame 3, and a conical enveloping part 4 which is provided with an electrode system 5 comprising three electron guns. The display window 1 is provided with a display screen 6 comprising a large number of phosphor elements luminescing in red, green and blue. The phosphor elements may be in the form of, for example, dots or strips, the longitudinal direction of which extends perpendicularly to the plane through the electron guns. The shadow mask 2 having a large number of apertures 7 is provided on the frame 3 while being subjected to mechanical tension, said frame being made of glass in the embodiment shown, but in an alternative embodiment it may also be made of metal. In addition, when the display window has peripheral upright edge, the shadow mask can be suspended between the upright edge and the envelope part.

One way of suspending the shadow mask 2 in the tensed condition, the tension remaining within the elastic range of the shadow mask, is described in U.S. Pat. No. 4,547,696.

The electrode system 5 for generating three electron beams is located in the enveloping part 4 which is conically shaped in the present example but which may be, for example, box-shaped in another embodiment of the invention. The electrode system 5 may be arranged in the enveloping part 4 either before or after the enveloping part 4 is secured to the display window 1.

In the manufacture of a colour display tube these parts must be accurately positioned relative to one another and assembled to form an envelope, such that electron beams generated by the electrode system 5 impinge on the associated phosphor elements via the apertures 7 in the shadow mask 2. One manner of achieving this accurate positioning is described in U.S. Pat. No. 4,547,696.

When the parts are accurately positioned relative to one another they are generally sealed to one another using a glass frit, so that an envelope is formed which is subsequently evacuated. During the sealing and evacuation steps, the colour display tube is heated to approximately 400° C., and the shadow mask can be displaced from its accurate position relative to the display screen. In accordance with the inventive method, this adverse displacement is compensated by accurately positioning the shadow mask relative to the display window after the envelope has been formed. An embodiment of a method in accordance with the invention will be described by way of example with reference to the FIGS. 2 and 3.

Figure 2:
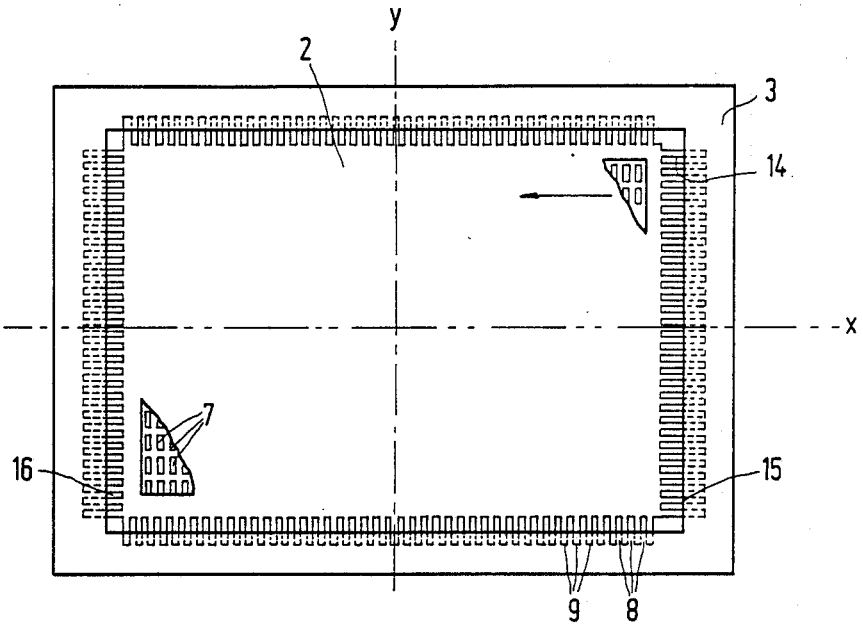
FIG. 2 is a diagrammatic elevational view of a tensed shadow mask which is secured to a frame.
Figure 3:
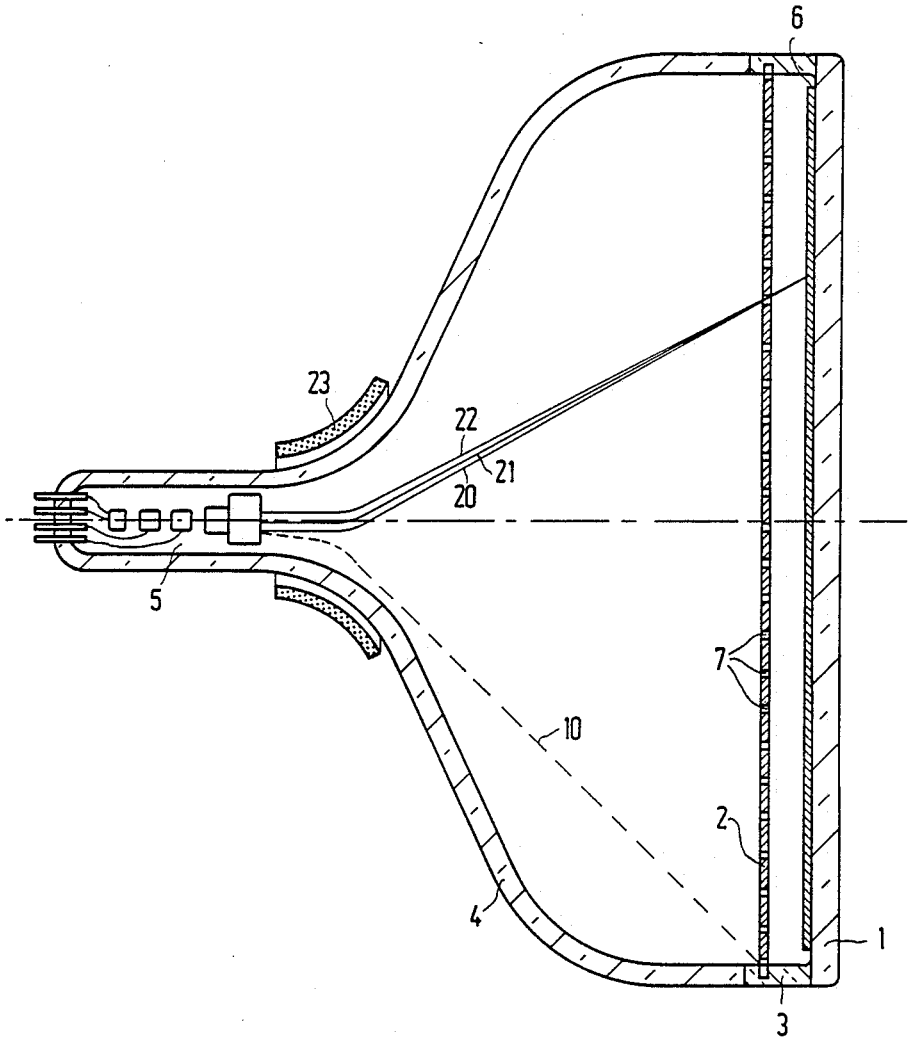
FIGS. 3 and 4 are diagrammatic sectional views of a colour display tube having a tensed shadow mask, after the envelope is formed.

FIG. 2 is a diagrammatic elevational view of a substantially rectangular shadow mask 2, viewed from the electrode system, which is suspended in a frame 3 using mechanical tension. In the present embodiment the shadow mask 2 is provided with a number of slots 8 at all the edges, such that strips 9 are formed at the edge of the shadow mask 2. In an alternative embodiment, the shadow mask may be provided with strips, for example, at two opposite edges. In the embodiment shown, the slots 8 extend as far as the edge of the shadow mask 2, but in an alternative embodiment of the invention they may be located entirely in the shadow mask 2. The mechanical tension to which the shadow mask 2 and the strips 9 are subjected remains within the elastic range of the material used for the shadow mask 2. The shadow mask 2 is suspended in the frame 3 such that the strips 9 remain partly free. Since the tension used to suspend the shadow mask 2 remains within the elastic range of the material used for the manufacture of the shadow mask 2, the strips may be regarded as springs. The tensed shadow mask 2 is in elastic equilibrium, the apertures 7 in the shadow mask 2 being in a predetermined position relative to the phosphor elements. By applying energy to certain strips, these strips are made to slacken so that the equilibrium is disturbed and owing to the tension in the shadow mask 2, this shadow mask attains another equilibrium in which the apertures 7 in the shadow mask 2 are displaced relative to their previous position. For example, if energy is applied to the strips 14 and 15 (FIG. 2), these strips 14 and 15 are heated, causing them to slacken. The mechanical tension used to suspend the shadow mask 2 in the frame 3 ensures that the apertures 7 in the shadow mask 2 are subject to a translation relative to the display screen in a direction along the x-axis, as is indicated by the arrows in FIG. 2. The strips 14 and 15 which slacken due to irradiation are stretched by this translation in the shadow mask 2 and obtain a length which corresponds to the new equilibrium. The magnitude of the translation may be influenced by changing the number of strips to which energy is applied. A translation of the apertures 7 in the shadow mask 2 in a direction along the y-axis can be carried out in an analogous manner.

A rotation about an axis which is perpendicular to the plane which is determined by the x-axis and the y-axis is obtained, for example, by applying energy to the strips 14 and 15.

A controlled displacement of the apertures in the shadow mask relative to the display window by deforming a number of strips can be attained when at least one of the edges of the shadow mask has strips, and it depends, inter alia, on the magnitude of the mechanical tension used to suspend the shadow mask and on the material of which the shadow mask is composed.

If, for example, a shadow mask of steel is used which is suspended in the envelope using a mechanical tension of 10 $N/mm^2$, a controlled positioning can be obtained when strips are used which each have a length and a width of, for example, 5 mm and 0.3 mm, respectively, and between which there is an interspace of 0.3 mm.

This enables those skilled in the art to determine the dimensions of the strips and the interspace between the strips for a defined shadow-mask material and a defined mechanical tension, such that a controlled positioning is obtained; it will be obvious that the invention is not limited to the above example.

To position the shadow mask 2 relative to the display screen 6 a test pattern is displayed on the display screen 6 preferably using the electrode system 5. In an alternative embodiment, the test pattern may be generated by a lamp. Optimizing this test pattern is carried out, for example, as follows. The test pattern displayed on the display screen 6 is examined and dependent on, for example, the colour errors present the direction and the magnitude of the displacement of the shadow mask 2 can be determined, such that the apertures 7 of the shadow mask 2 are more accurately positioned relative to the phosphor elements of the display screen 6. The current passing through the deflection coil system 23 is adjusted by means of a control unit (not shown in FIG. 3) such that those strips of the shadow mask 2 are irradiated by an electron beam 10 which are necessary to obtain the desired.

Figure 4:
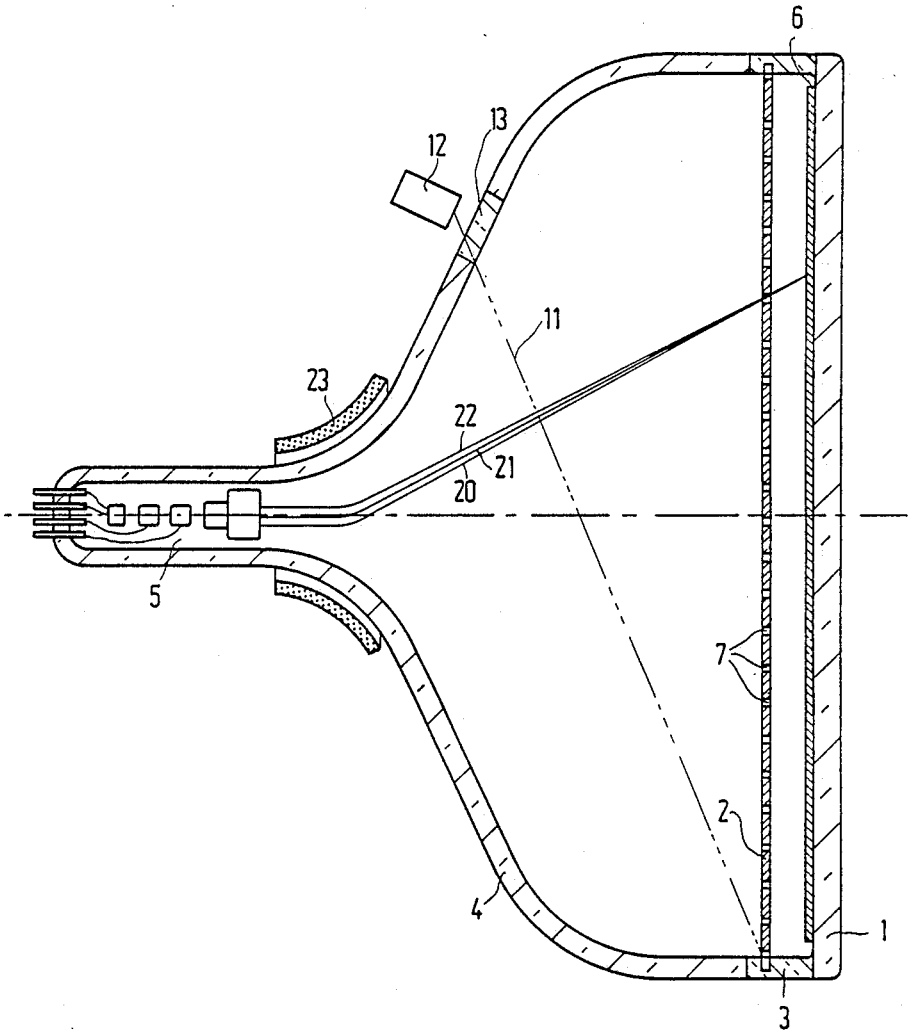

In FIG. 4 energy is alternatively applied to the strips by a laser beam 11 generated by a laser 12 impinging on the desired strips. To this end, the laser beam 11 is passed through a light-transmitting window 13 which is provided in the conical envelope 4.

Figure 5:
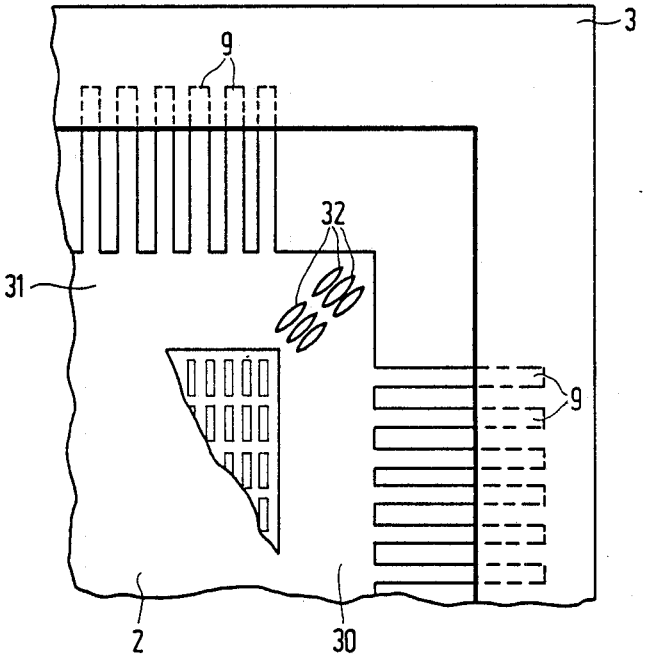
FIG. 5 is a diagrammatic representation of a corner of a shadow mask which is suspended so as to be tensed at all the edges.

FIG. 5 is a diagrammatic representation of a corner of a shadow mask 2 having strips 9 at all the edges. The shadow mask 2 is secured to the frame 3, so as to be tensed at all the edges. As the directions of the mechanical tension acting on the edges 30 and 31 extend substantially perpendicularly to each other, stresses may occur in the corner of the shadow mask 2 which may bring about undesirable curvatures in the corner of the shadow mask. These undesirable curvatures may lead to colour errors in an image to be displayed. To preclude the formation of these curvatures, the corner of the shadow mask 2 is provided with recesses 32 by means of which a uniform stress distribution in the corner of the shadow mask 2 is obtained.

The recesses 32 may be, for example, weakened portions or apertures in the shadow mask 2. The shape and orientation of the recesses 32 leading to a uniform stress distribution may have many different embodiments and can be determined experimentally by those skilled in the art as a function of, inter alia, the shadow mask material. In the embodiment shown, the recesses 32 are oval apertures whose longitudinal axis extends substantially parallel to the diagonal in the relevant corner.

After assembly of the colour display tube, the method in accordance with the invention permits an inaccurately aligned shadow mask to be accurately aligned relative to the display window, such that almost no colour errors occur during operation of the colour display tube.

It will be clear that the invention is not limited to the embodiments described herein, and that many variations are possible to those skilled in the art without departing from the scope of the invention.

We claim:

1. A method of manufacturing a colour display tube, the method comprising the steps of: (a) providing a display window with a display screen of phosphor elements luminescing in different colours; (b) suspending a tensed substantially rectangular shadow mask having a large number of apertures in the display window; and (c) securing an enveloping part to the display window, such that an envelope is formed; characterized in that after the envelope is formed the shadow mask and the display window are positioned relative to one another by locally deforming the tensed shadow mask by applying energy.

2. A method as claimed in claim 1, in which prior to suspending the shadow mask a large number of slots are formed at at least one of its edges, such that strips are formed at such edge of the shadow mask, the shadow mask is suspended in the display window using tension, such that the slots remain free in part, and the positioning of the shadow mask is governed by the application of energy to strips.

3. A method as claimed in claim 1 or 2, in which the energy is applied by irradiation using an electron beam which is generated by an electrode system which is arranged in the enveloping part.

4. A method as claimed in claim 1 or 2, in which the energy is applied by irradiation using a laser beam which passes through a light-transmitting aperture in the envelope.

5. A method as claimed in claim 1 or 2, in which a test pattern generated using an electrode system arranged in the enveloping part is displayed on the display screen via the shadow mask and positioning takes place until a desired test pattern is displayed.

6. A colour display tube having an envelope, a display window which is provided with a display screen of phosphor elements luminescing in different colours, and a tensed substantially rectangular shadow mask having a large number of apertures and suspended in the envelope, characterized in that the shadow mask is provided with slots such that strips are formed extending to at least one of its edges, the lengths and widths of the strips and the interspace between the strips being such that in the case of deformation of at least one of the strips the shadow mask can be positioned relative to the display window in a controlled manner.

7. A colour display tube as claimed in claim 6, in which the shadow mask is suspended in the envelope so as to be tensed at all the edges, and the shadow mask has recesses in its corners to uniformly distribute the mechanical tension in the corners of the shadow mask.

* * * * *